US010193269B2

(12) United States Patent
Puskar et al.

(10) Patent No.: US 10,193,269 B2
(45) Date of Patent: Jan. 29, 2019

(54) CONNECTOR MAINTENANCE PANEL

(71) Applicant: Oceaneering International, Inc., Houston, TX (US)

(72) Inventors: Taylor Puskar, Houston, TX (US); Benjamin Ross, Houston, TX (US); Mohamed Salhi, Katy, TX (US)

(73) Assignee: Oceaneering International, Inc.

( * ) Notice: Subject to any disclaimer, the term of this patent is extended or adjusted under 35 U.S.C. 154(b) by 0 days.

(21) Appl. No.: 15/606,612

(22) Filed: May 26, 2017

(65) Prior Publication Data

US 2017/0346215 A1 Nov. 30, 2017

Related U.S. Application Data

(60) Provisional application No. 62/342,279, filed on May 27, 2016.

(51) Int. Cl.

| | |
|---|---|
| ***H01R 13/52*** | (2006.01) |
| ***H01R 13/523*** | (2006.01) |
| ***H01R 25/00*** | (2006.01) |
| *E21B 33/03* | (2006.01) |
| *E21B 33/035* | (2006.01) |
| *E21B 33/038* | (2006.01) |
| *H01R 13/46* | (2006.01) |

(52) U.S. Cl.

CPC ..... *H01R 13/5202* (2013.01); *E21B 33/0385* (2013.01); *H01R 13/523* (2013.01); *H01R 13/5219* (2013.01); *H01R 25/006* (2013.01); *E21B 33/03* (2013.01); *E21B 33/035* (2013.01); *E21B 33/038* (2013.01); *H01R 13/46* (2013.01); *H01R 13/52* (2013.01)

(58) Field of Classification Search

CPC .... H01R 13/5202; H01R 13/46; H01R 13/52; H01R 13/5219; H01R 13/523; E21B 33/0385; E21B 33/03; E21B 33/035; E21B 33/038

USPC ..... 439/271

See application file for complete search history.

(56) References Cited

U.S. PATENT DOCUMENTS

| | | | | |
|---|---|---|---|---|
| 2012/0085544 | A1* | 4/2012 | Shilling | E21B 17/015 166/345 |
| 2012/0222865 | A1* | 9/2012 | Larson | E21B 17/085 166/340 |
| 2013/0008151 | A1* | 1/2013 | Munstereifel | B63G 8/001 60/325 |
| 2016/0023843 | A1* | 1/2016 | Donahue | B65D 88/78 405/210 |
| 2016/0109874 | A1* | 4/2016 | Holmes | G05B 19/406 700/275 |

* cited by examiner

*Primary Examiner* — Jean F Duverne
(74) *Attorney, Agent, or Firm* — Maze IP Law, P.C.

(57) ABSTRACT

A predetermined set of connector maintenance functions may be accomplished subsea using a connector maintenance panel which comprises a panel and a plurality of fixed connector interfaces disposed through a predetermined portion of the connector maintenance panel. The connector maintenance panel subsea may be deployed and powered subsea, such as from an external source, and a predetermined set of connector related functions performed in a sequence by sequentially using the connector interface operable to perform a connector related function of the predetermined connector related functions in the predetermined sequence.

12 Claims, 9 Drawing Sheets

CONNECTOR MAINTENANCE PANEL

RELATIONSHIP TO PRIOR APPLICATIONS

This application claims priority through U.S. Provisional Application 62/342,279 titled "Connector maintenance panel," filed May 27, 2016.

BACKRGOUND OF THE INVENTION

Jumpers and conduits located subsea often have a need for replacement of seals and/or gaskets and the like. This often requires removing the jumper or conduit to a surface location, which can be costly. Moreover, often times maintenance functions require multiple tools to be used to perform a required maintenance function.

FIGURES

The figures supplied herein illustrate various embodiments of the invention.

BRIEF DESCRIPTION OF EMBODIMENTS

As used herein, "seal" may be a seal, a gasket, or the like and "connector" may be a jumper or other conduit or the like.

Connector maintenance panel 1 comprises several separate functional components related to maintenance, such as jumper or connector maintenance, in a single panel. In an exemplary embodiment, as described below, there are three such functions but there is no requirement that there by anything other than a plurality of connector maintenance functions. In its embodiments, connector maintenance panel 1 provides controls and connector interfaces for each required function on a single panel, allowing the actions to be carried out sequentially from a single panel rather than multiple, separate tools. This can help ensure that each function is available for an entire maintenance sequence. Because the entire sequence can be completed subsea, the connector, e.g. a jumper or the like, does not need to be returned to a surface location for maintenance such as seal and/or gasket maintenance.

Figure 1:
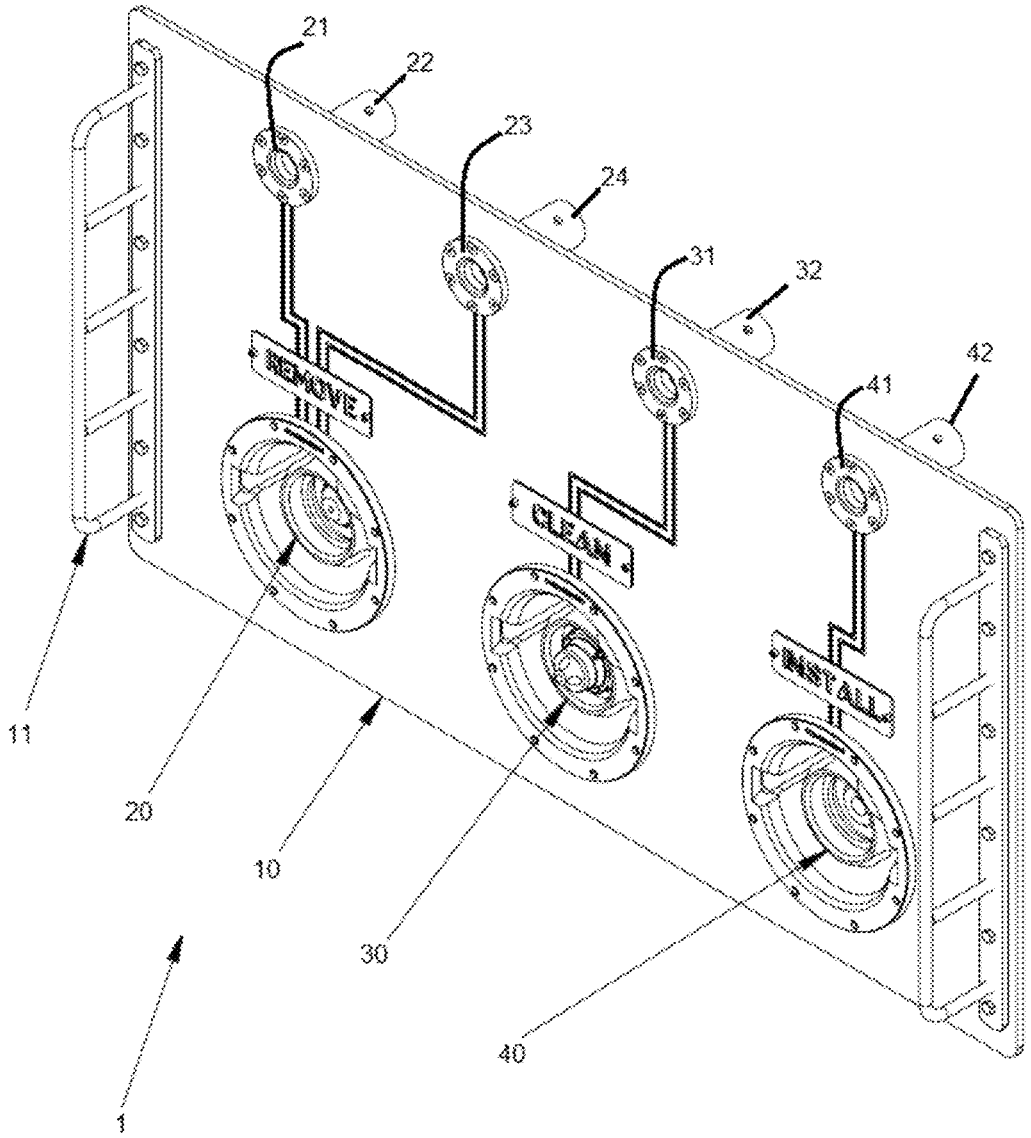
FIG. 1 is a front view in partial perspective if an exemplary connector maintenance panel 1.

Referring now to FIG. 1, in embodiments connector maintenance panel 1 comprises panel 10 and a plurality of fixed connector interfaces such as interfaces 20,30,40 disposed through a predetermined portion of panel 10, each connector interface comprising a port configured to accept a predetermined connector maintenance tool, each connector interface operative to perform a predetermined connector maintenance function subsea. Each fixed connector interface of the plurality of fixed connector interfaces is usable to aid in performed a corresponding separate, dedicated connector maintenance function from a predetermined set of functions subsea. Typically, each fixed connector interface 20,30,40 comprises an outer housing sized to accept a predetermined portion of a connector into the outer housing, and configured to be secured into panel 10; a tool disposed within the outer housing and configured to perform the predetermined connector maintenance function; and a power interface operative coupled to the tool.

As illustrated in FIG. 1, maintenance panel 1 may also comprise one or more handles 110 configured to allow a remotely operated vehicle (ROV) to attach to and otherwise maneuver maintenance panel 1.

One or more power interfaces, such as ports 21, 23, 21, and 41 as well as 22,24,32, and 42, may be present and operatively in communication with the plurality of fixed connector interfaces. These power interfaces may be hot stab power interfaces. In embodiments, each fixed connector interface, e.g. 20,30,40, comprises its own power interface operatively in communication with that connector interface. One or more ports 21,22,23,24,31,32,41,42 may be a hot stab power port and may comprise a dual port hot stab port.

Referring additionally to FIGS. 2-7, again by way of example and not limitation, an illustrative embodiment comprises three functions: seal removal via seal removal interface 20; seal cleaner via seal cleaner interface 30; and seal installation via seal installation interface 40. However, these are but illustrative and not meant to be limiting as other functionality and appropriate interfaces may be part of the invention. These three functions will be used herein solely by way of example and not limitation.

Figure 2:
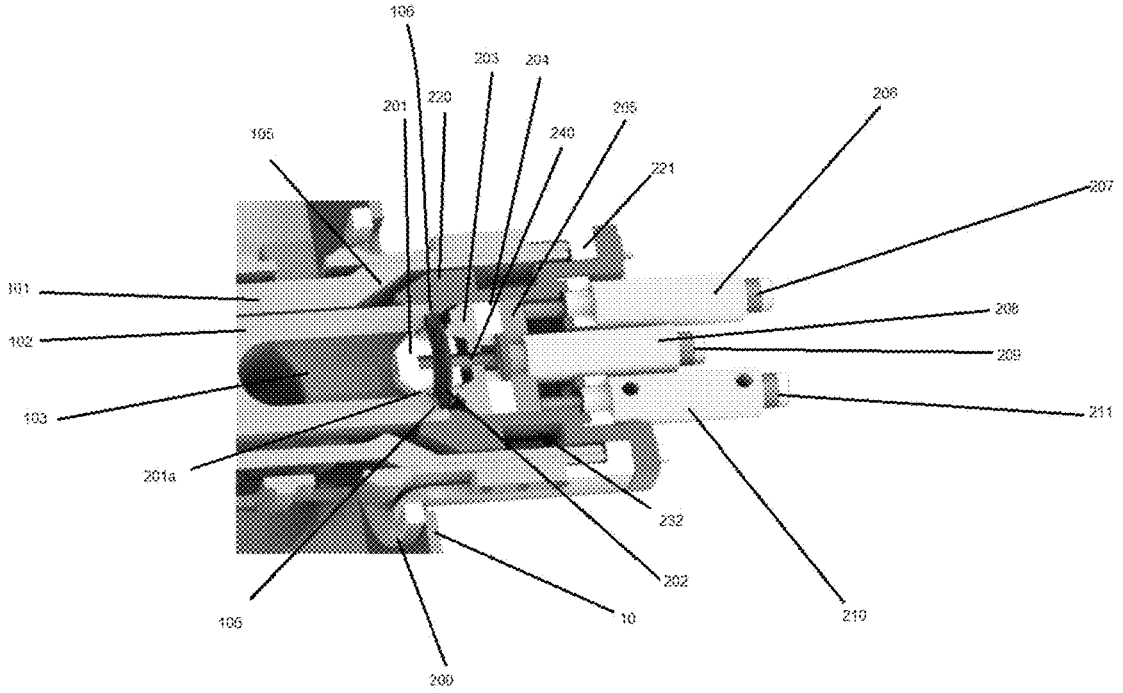
FIG. 2 is a cutaway view in partial perspective of an exemplary seal removal interface.

Referring specifically to FIG. 2, seal removal interface 20 (FIG. 1) comprises seal removal interface outer housing 200 which is configured to accept a portion of a connector, e.g. connector end 101, into seal removal interface outer housing 200. In some embodiments, seal removal interface outer housing 200 comprises stop 221 to limit travel of connector end 101 into seal removal interface outer housing 200. In embodiments, seal removal interface outer housing 200 is insertable into and securable to panel 10.

Tool housing 220 may be present and configured to fit within seal removal interface outer housing 200 and be securely fastened to seal removal interface outer housing 200. Tool housing 220 may further comprise locking channel 232, described more fully below, to aid in positioning and/or locking connector end 101 into seal removal interface 20.

In addition, one or more actuator movers 208, which may be hydraulically or electrically operated cylinders, may be secured onto or into piston 205, gasket 204, and travel limit gasket 203 which are movably disposed within tool housing 220. Travel limit gasket 203 may be configured to prevent travel of piston 205 within tool housing 220. Gasket 204 may be disposed intermediate piston 205 and travel limit gasket 203. One or more piston actuators 206,210, which may be hydraulically or electrically operated cylinders, may be operatively connected to piston 205 and operative to move piston 205 into and retract piston 205 out from tool housing 220, such as by using actuator power ports 207 and 211.

Mandrel 201 is typically configured to intrude at least partially into conduit 103 of connector end 101. Mandrel 201 may be wedge-shaped and comprise grippers 201*a*. Mandrel 201 is typically disposed at an end of mandrel actuator 240 and configured to removably accept seal 202. As illustrated and as further described below, mandrel actuator 240 is slidably disposed into a portion of piston 205 and/or gasket 204. Mandrel actuator 240 is typically operatively connected to one or more actuator movers 208 which may be hydraulically or electrically powered such as via actuator mover power connector 209. Mandrel 201 is configured to be inserted into seal 202 and, upon retraction, secure and hold onto seal 202 such as by using grippers 201*a*.

Figure 3:
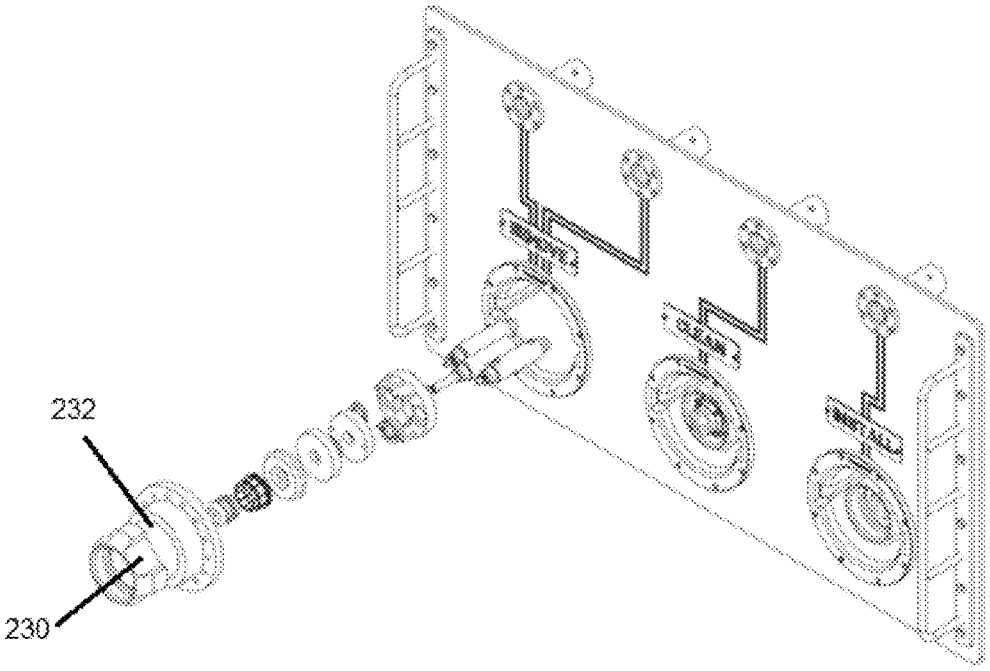
FIG. 3 is an exploded view in partial perspective of an exemplary seal removal interface illustrating guide channels and locking channels.

Referring additionally to FIG. 3, connector end 101 (FIG. 2) may comprise one or more guides 107 (FIG. 2) which may be accepted into guide channels 230, which may be part of tool housing 220 (FIG. 2), as connector end 101 is accepted into tool housing 220. Once connector end 101 has proceeded a predetermined distance into tool housing 220, guides 107 may clear guide channels 230 and connector end 101 rotated such that guides 107 enter into, and are secured by, locking channel 232 which is typically oriented substantially orthogonally with respect to guide channels 230.

Figure 4:
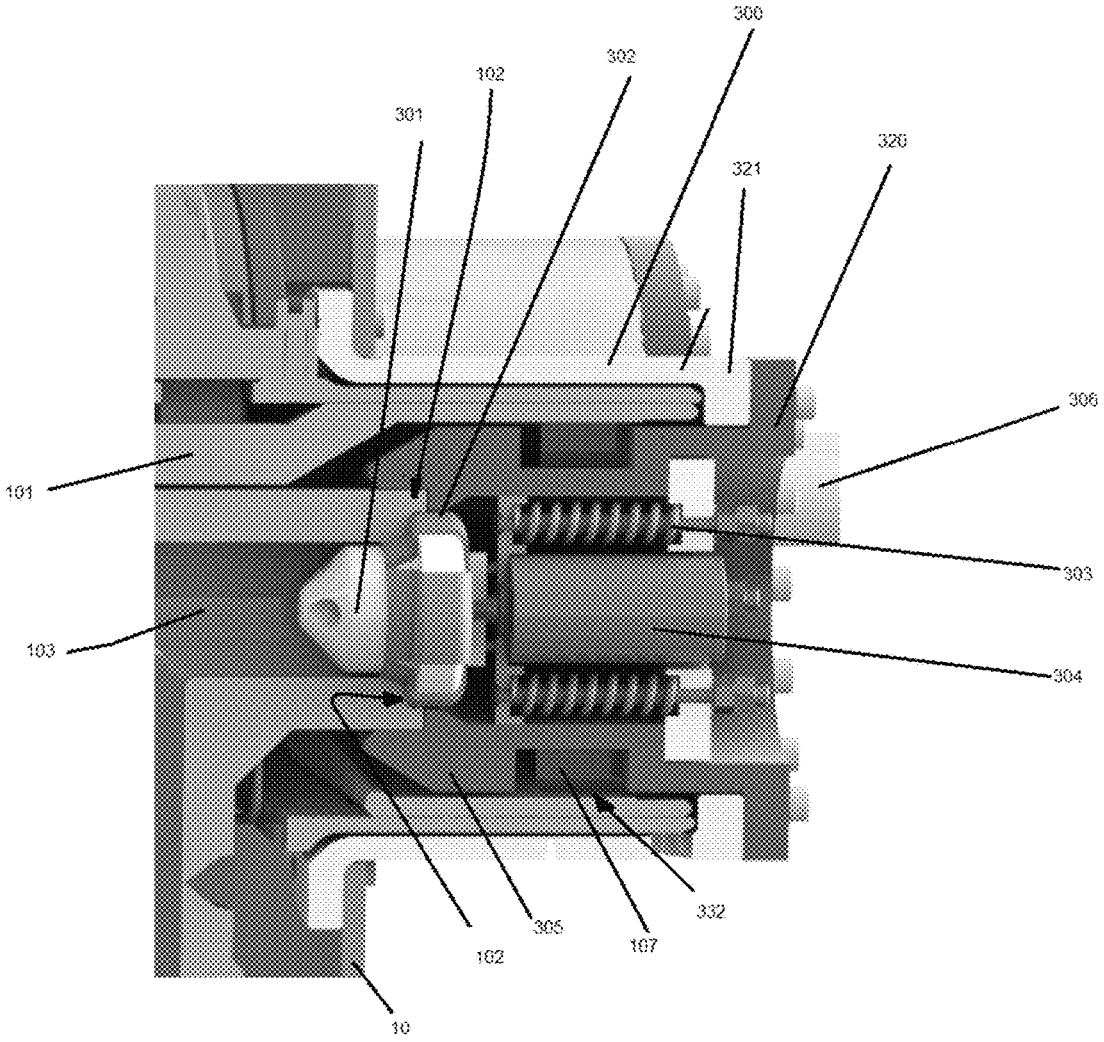
FIG. 4 is a cutaway view in partial perspective of an exemplary seal cleaner interface.
Figure 5:
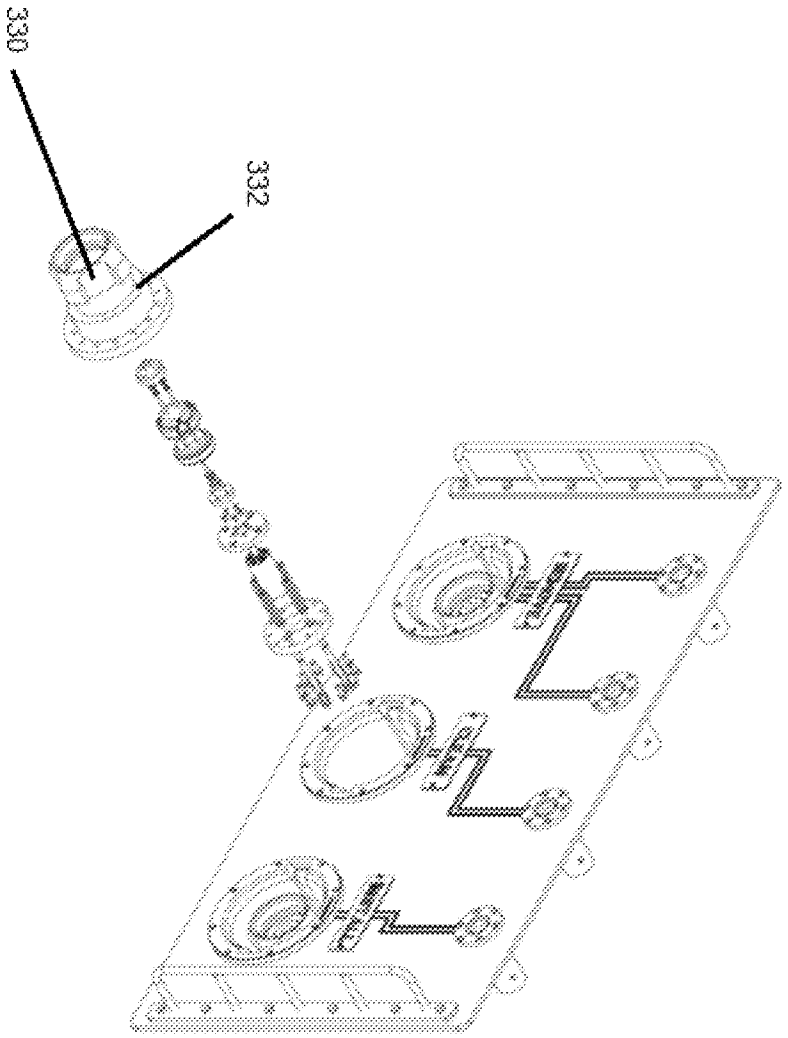
FIG. 5 is an exploded view in partial perspective of an exemplary seal cleaner interface illustrating guide channels and locking channels.

Referring now to FIG. 4, seal cleaner interface 30 (FIG. 1) comprises seal cleaner interface outer housing 300 which is configured to accept a portion of a connector, e.g. connector end 101, into seal cleaner interface outer housing 300. In some embodiments, seal cleaner interface outer housing 300 comprises stop 321 to limit travel of connector end 101 into seal cleaner interface outer housing 300. In embodiments, seal cleaner interface outer housing 300 is insertable into and securable to panel 10.

Tool housing 320 may be present and configured to fit within seal cleaner interface outer housing 300 and be securely fastened to seal removal interface outer housing 300. As with seal removal interface 20, tool housing 320 may comprise guide channels 330 (FIG. 5) and locking channel 332 (FIG. 5) which is typically oriented substantially orthogonally with respect to guide channels 330 and which operate as do locking channel 232 and guide channels 230.

Cleaner mandrel 301 is typically configured to intrude partially into conduit 103 of connector end 101 and comprises abrasive 302 which may be integral to or replaceably positioned on or in cleaner mandrel 301. Abrasive 302 is configured to engage seal end 102 of connector end 101. Cleaner mandrel 301 is operatively connected to motor 304, which is operative to rotate cleaner mandrel 301. Motor 304 may be secured to tool housing 320 and tensioned using one or more springs 303. Power port 306 may be operatively connected to motor 304 which may be a hydraulic motor, an electrical motor, or the like.

Figure 6:
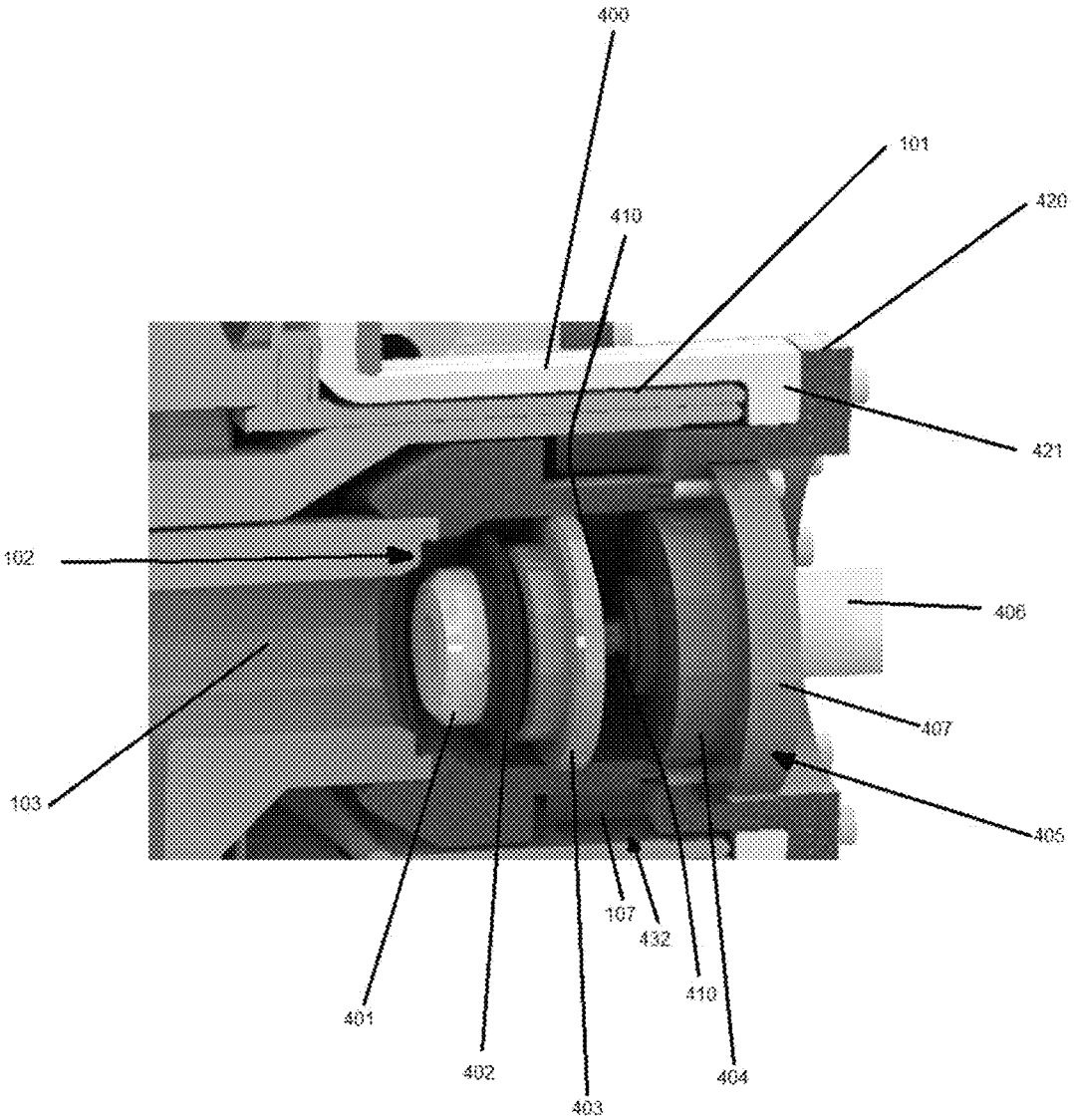
FIG. 6 is a cutaway view in partial perspective of an exemplary seal insertion interface.

Referring specifically to FIG. 6, seal insertion interface 20 comprises seal insertion interface outer housing 400 which is configured to accept a portion of a connector, e.g. connector end 101, into seal insertion interface outer housing 400. In some embodiments, seal insertion interface outer housing 400 comprises stop 421 to limit travel of connector end 101 into seal insertion interface outer housing 400. In some embodiments, seal insertion interface outer housing 400 is insertable into and securable to panel 10.

In embodiments, seal insertion interface 40 (FIG. 1) is similar to, but not the same as, seal removal interface 20 (FIG. 1). Tool housing 420 may be present and configured to fit within seal insertion interface outer housing 400 and be securely fastened to seal insertion interface outer housing 400.

Piston 405 may disposed at least partially within tool housing 302 and comprise outer portion 407 and inner piston 404, where outer piston 407 is limited in travel within tool housing 420. Piston 405 is typically powered by power port 406, and can be hydraulically or electrically actuated.

In most embodiments, mandrel 401 is configured to accept seal 402 but, once seal 402 is placed proximate seal end 102, mandrel 401 can be withdrawn and leave seal 402 in place such as by using piston 405. Actuator 410 may be operatively attached to mandrel 401, e.g. by being operatively connected to piston 405.

Seal insertion stopper 403 may be operative to allow mandrel 401 to be retracted and leave seal 402 in place. In embodiments, seal insertion stopper 403 is operatively connected to piston 405.

As with seal removal interface 20, tool housing 420 may comprise guide channels 430 (FIG. 7) and locking channel 432 (FIG. 7) which is typically oriented substantially orthogonally with respect to guide channels 430 and which operate as do locking channel 232 and guide channels 230.

In the operation of exemplary embodiments, a predetermined set of connector maintenance functions may be accomplished subsea using connector maintenance panel 1 (FIG. 1), which is as described above. Connector maintenance panel 1 is typically deployed subsea and powered from an external source. Connector maintenance panel 1 may be deployed subsea as part of a mud mat, by being mounting to a subsea structure, by being mounted to an ROV cage, or the like. In certain embodiments, connector maintenance panel 1 may be deployed subsea by deploying connector maintenance panel 1 such that the plurality of connector interfaces 20,30,40 are fixed on a structure.

Power may be supplied from an external source such as by powering connector maintenance panel 1 from a remotely operated vehicle (ROV) hydraulic power source, powering connector maintenance panel 1 from an ROV manipulator, powering connector maintenance panel 1 from a non-ROV subsea power unit, or the like, or a combination thereof.

Referring generally to FIG. 1.1, once connector maintenance panel 1 is deployed, a predetermined set of connector related functions may be performed by inserting connector end 101 (FIG. 2) into a first selected connector interface, e.g., 20, of the plurality of connector interfaces where the first selected connector interface is assigned to a first predetermined connector related function of the predetermined connector related functions in a predetermined sequence. That first predetermined connector related function is performed, by way of example and not limitation, by actuating one or more actuators 206,210 (FIG. 2) to push mandrel 201 (FIG. 2) into currently used seal 202 (FIG. 2). Once positioned, actuator 208 (FIG. 2) may be used to move a seal retriever, e.g. mandrel 201 (FIG. 2), into seal 202 and lock mandrel 201 into place to retain seal 202. Once seal 202 is secured, one or more actuators 206,210 may be retracted remove seal 202.

If further connector related functions are required, the connector is inserted into each subsequent selected connector interface of the plurality of connector interfaces assigned to each subsequent connector related function in the predetermined sequence and that subsequent connector related function. Once one or more of the connector related functions are performed, the connector may be removed from connector maintenance panel 1, e.g. after a final predetermined connector related function in the sequence has been performed.

By way of example and not limitation, the predetermined connector related function sequence may comprise seal related maintenance. For these exemplary functions, referring generally to FIGS. 2A-2B, connector end 101 is positioned proximate connector maintenance panel 1, either by moving connector end 101, connector maintenance panel 1, or both.

Figure 2A:
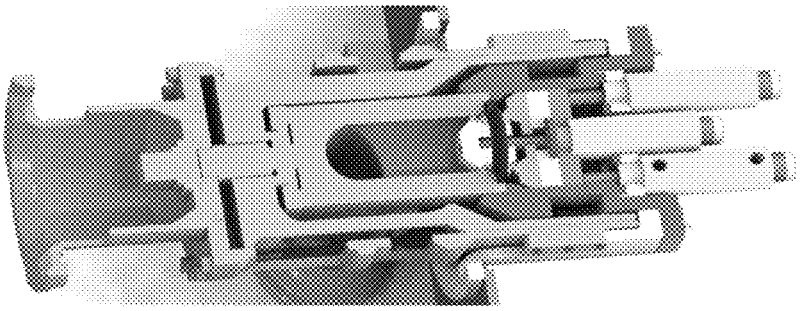
FIGS. 2A-2B are cutaway views in partial perspective of an exemplary seal removal interface illustrating a sequence of seal removal steps.
Figure 2B:
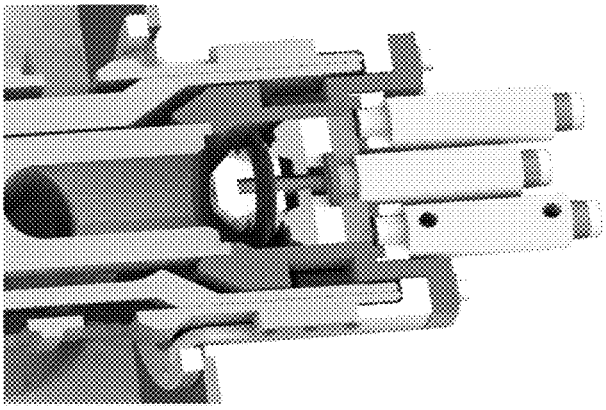

Referring still to FIGS. 2A, once positioned appropriately, connector end 101 (FIG. 2) is inserted into a first selected connector interface, e.g. seal removal interface 20 (FIG. 1). As illustrated in FIG. 2B, the first selected connector interface, e.g. seal removal interface 20, is then used to remove an existing seal, e.g. seal 202 (FIG. 2) from the connector using seal removal interface 20, as described above.

Referring generally to FIG. 4, once seal 202 is removed, connector end 101 may be removed from connector maintenance panel 1 (FIG. 1) and connector end 101 inserted into a second selected connector interface, e.g. seal cleaner interface 30 (FIG. 1). Seal cleaner interface 30 may be used to clean seal interface portion 102 of connector end 101 such as by abrading seal interface portion 102 of connector end 101. By way of example and not limitation, seal cleaner interface 30 may be used to clean seal interface portion 102 of connector end 101 by moving mandrel 301 into position proximate seal interface portion 102 from which seal 202 (FIG. 2) was removed. As described above, mandrel 301 typically comprises surface cleaner 302 and is operatively connected to motor 304. Springs 303 may be tightened to preload mandrel 301 with spring force and motor 304 actuated to abrade seal interface portion 102, thereby cleaning seal interface portion 102.

Figure 6A:
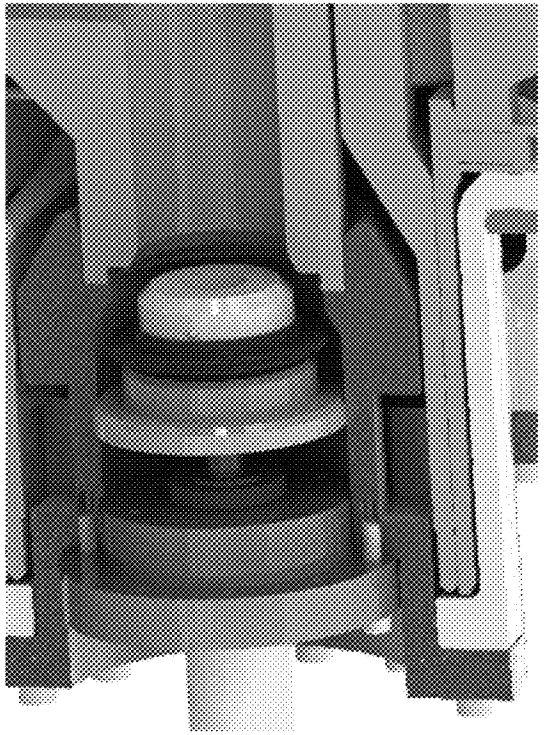
FIGS. 6A-6C are cutaway views in partial perspective of an exemplary seal insertion interface illustrating a sequence of seal installation steps.
Figure 6B:
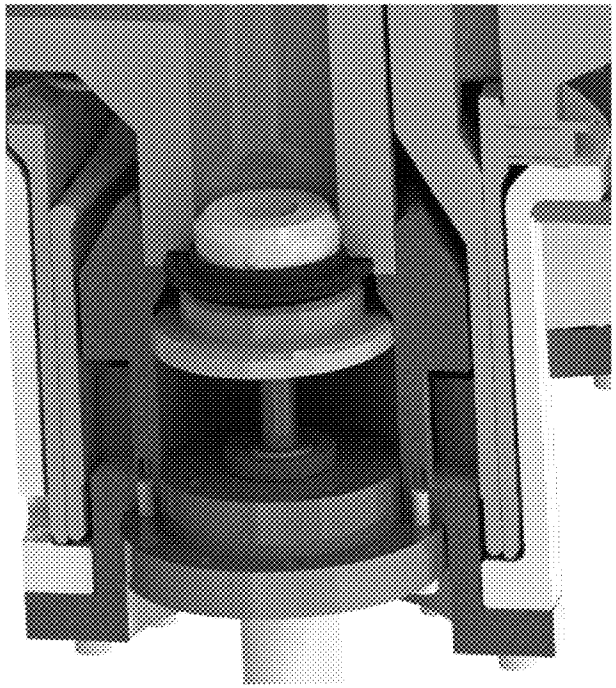
Figure 6C:
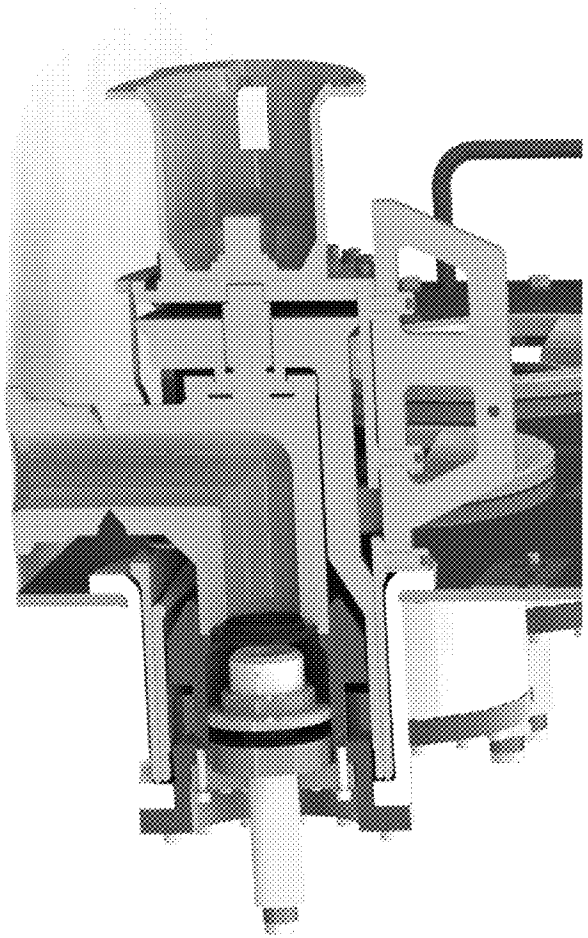
Figure 7:
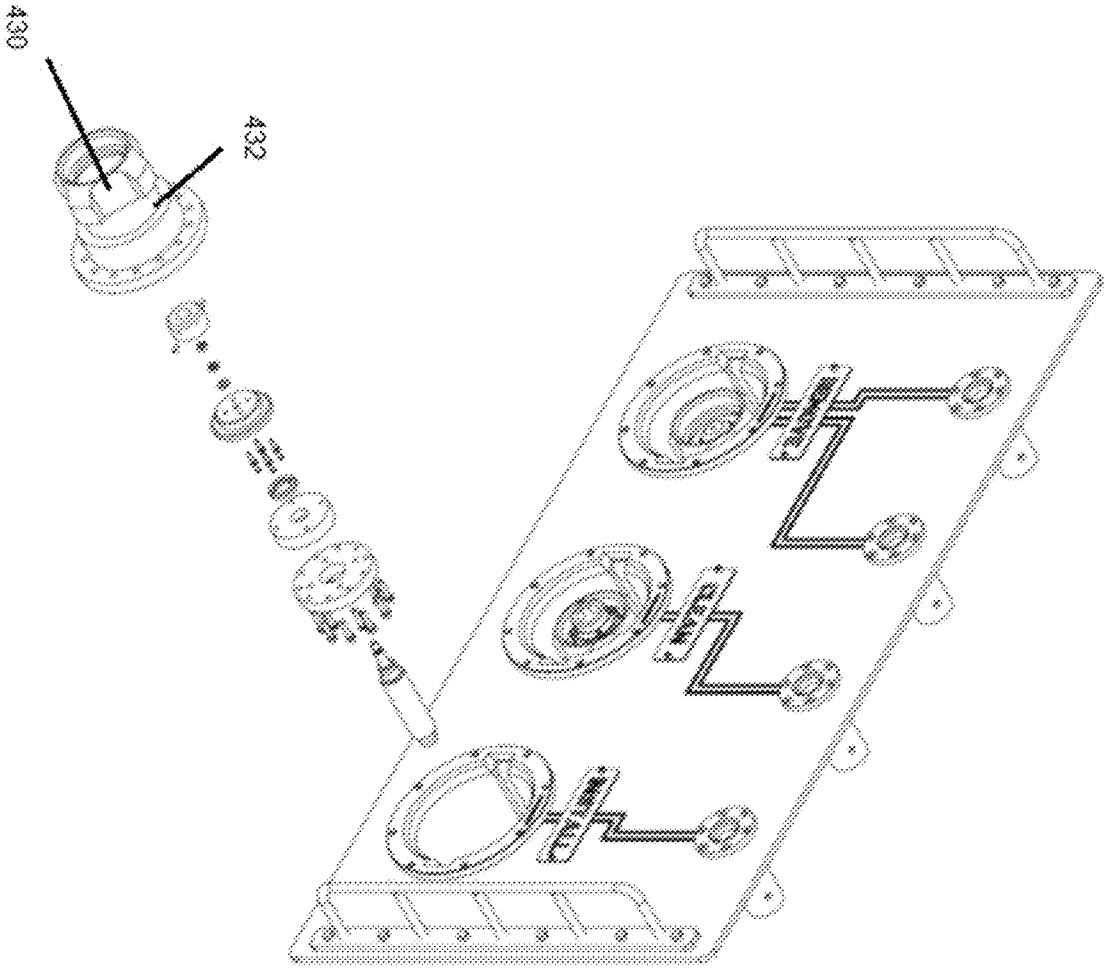
FIG. 7 is an exploded view in partial perspective of an exemplary seal insertion interface illustrating guide channels and locking channels.

Referring generally to FIGS. 6A-6C, once seal interface portion 102 of connector end 101 has been cleaned, connector end 101 may be removed from seal cleaner interface 30 (FIG. 1). If a new seal is required, connector end 101 may be inserted into a third selected connector interface configured for seal installation, e.g. seal installation interface 40 (FIG. 1), and seal installation interface 40 used to install a new seal such as seal 402 into connector end 101 proximate seal interface portion 102 by positioning new seal 402 onto mandrel 401 (FIG. 6A) and actuating actuator 102 to push new seal 402 into connector end 101 proximate seal interface portion 102 (FIG. 6B). Once positioned, actuator 102 may be activated to retract, leaving new seal ring 402 installed in connector end 101 (FIG. 6C).

All of these functions may be performed subsea. In addition, for any of these functions, if connector end 101 comprises connector guide 107, one or more connector interfaces 20,30,40 may comprise one or more guide insertion channels, such as 230,330,430, and guide locking channels, such as 232,332,432, as described above. In such embodiments, one or more connector guides 107 are inserted into a corresponding guide insertion channel and connector end 101 advanced into connector interface 20,30, 40 until each such connector guide 107 is situated within a guide locking channel at which time connector end 101 or connector interface 20,30,40 may be rotated until connector guide 107 travels within the guide locking channel to a position, preventing extraction of connector end 101 from the guide locking channel.

The foregoing disclosure and description of the inventions are illustrative and explanatory. Various changes in the size, shape, and materials, as well as in the details of the illustrative construction and/or an illustrative method may be made without departing from the spirit of the invention.

What is claimed is:

1. A method of accomplishing a predetermined set of connector maintenance functions subsea using a connector maintenance panel, the connector maintenance panel comprising a panel and a plurality of fixed connector interfaces disposed through a predetermined portion of the connector maintenance panel, the method comprising:

a. deploying the connector maintenance panel subsea;

b. powering the connector maintenance panel from an external source; and c. performing a predetermined set of connector related functions by:

i. inserting a connector into a first selected connector interface of the plurality of connector interfaces, the first selected connector interface operable to perform a first predetermined connector related function of the predetermined connector related functions in a predetermined sequence;

ii. performing the first predetermined connector related function; and iii. if further connector related functions are required, inserting the connector into each subsequent selected connector interface of the plurality of connector interfaces, each subsequent selected connector interface operative to perform a subsequent connector related function in the predetermined sequence.

2. The method of accomplishing a predetermined set of connector maintenance functions subsea using a connector maintenance panel of claim 1, further comprising removing the connector from the connector maintenance panel after a final predetermined connector related function in the sequence has been performed.

3. The method of accomplishing a predetermined set of connector maintenance functions subsea using a connector maintenance panel of claim 1, wherein the predetermined connector related function sequence comprises seal related maintenance, the method further comprising:

a. positioning the connector proximate the connector maintenance panel;

b. inserting the connector into the first selected connector interface, the first selected connector interface configured for seal removal;

c. using the first selected connector interface to remove an existing seal from the connector using the first selected connector interface;

d. removing the connector from the connector maintenance panel;

e. inserting the connector into a second selected connector interface, the second selected connector interface configured for seal interface portion cleaning;

f. using the second selected connector interface to clean the seal interface portion of the connector;

g. removing the connector from the connector maintenance panel;

h. inserting the connector into a third selected connector interface, the third selected connector interface configured for seal installation;

i. using the third selected connector interface to install a new seal into the connector proximate the seal interface portion of the connector.

4. The method of accomplishing a predetermined set of connector maintenance functions subsea using a connector maintenance panel of claim 1, wherein using the first selected connector interface to remove an existing seal from the connector using the first selected connector interface comprises:

a. actuating a cylinder of the first selected connector interface to push a mandrel of the first selected connector interface into a currently used seal present in the connector;

b. actuating an actuator of the first selected connector interface to move a seal retriever into the seal and lock the seal retriever into place to retain the seal; and c. retracting a piston actuator of the first selected connector interface to remove the seal from the connector.

5. The method of accomplishing a predetermined set of connector maintenance functions subsea using a connector maintenance panel of claim 1, wherein using the second selected connector interface to clean an existing seal from the connector using the first selected connector interface comprises:

a. moving a mandrel of the second selected connector interface into position proximate the seal interface portion, the mandrel comprising a surface cleaner, the mandrel operatively connected to a motor;

b. tightening a connector to preload the mandrel with spring force; and c. actuating the motor, thereby cleaning the seal interface portion.

6. The method of accomplishing a predetermined set of connector maintenance functions subsea using a connector maintenance panel of claim 1, wherein using the third selected connector interface to install a new seal into the connector proximate the seal interface portion of the connector comprises:

a. positioning a new seal onto a mandrel of the third connector interface;

b. actuating a piston of the third connector interface operatively connected to the mandrel of the third connector interface to push the new seal into a connector proximate the seal interface portion; and c. retracting the piston, leaving the new seal in the connector.

7. The method of accomplishing a predetermined set of connector maintenance functions subsea using a connector maintenance panel of claim 1, wherein the predetermined connector related function comprises removing a seal, the connector comprises a connector guide, and the connector interface comprises a guide insertion channel and a guide locking channel disposed within the connector and oriented substantially orthogonally with respect to the guide insertion channel, inserting the connector into one of the plurality of connector interfaces further comprising:

a. inserting the connector guide into the guide insertion channel;

b. advancing the connector into the connector interface until the connector guide is situated within the guide locking channel; and c. rotating the connector or the connector interface until the connector guide travels within the guide locking channel to a position preventing extraction of the connector from the connector interface.

8. The method of accomplishing a predetermined set of connector maintenance functions subsea using a connector maintenance panel of claim 1, wherein deploying the panel subsea comprises deploying the panel as part of a mud mat.

9. The method of accomplishing a predetermined set of connector maintenance functions subsea using a connector maintenance panel of claim 1, wherein deploying the panel subsea comprises mounting the panel to a subsea structure.

10. The method of accomplishing a predetermined set of connector maintenance functions subsea using a connector maintenance panel of claim 1, wherein deploying the panel subsea comprises mounting the panel to an ROV cage.

11. The method of accomplishing a predetermined set of connector maintenance functions subsea using a connector maintenance panel of claim 1, wherein deploying the panel subsea comprises deploying the panel such that the plurality of connector interfaces are fixed on a structure.

12. The method of accomplishing a predetermined set of connector maintenance functions subsea using a connector maintenance panel of claim 1, wherein powering the panel from an external source comprises powering the panel from a remotely operated vehicle (ROV) hydraulic power source, powering the panel from an ROV manipulator, or powering the panel from a non-ROV subsea power unit.

* * * * *